United States Patent [19]

Tenthoff et al.

[11] 4,026,462

[45] May 31, 1977

[54] SEPARATING DRUM FOR THE CENTRIFUGAL TREATMENT OF MIXTURES

[75] Inventors: Aloys Tenthoff, Oelde; Tonius Schulze Schwicking, Ostenfelde, both of Germany

[73] Assignee: Westfalia Separator AG, Oelde Westfalen, Germany

[22] Filed: Jan. 19, 1976

[21] Appl. No.: 650,577

[30] Foreign Application Priority Data

Feb. 1, 1975 Germany ..... 2504226

[52] U.S. Cl. ..... 233/29

[51] Int. Cl.² ..... B04B 11/06

[58] Field of Search ..... 233/20 R, 20 A, 27, 233/28, 29, 19 R, 19 A, 1 R, 40, 41

[56] References Cited

UNITED STATES PATENTS

| | | | |
|---|---|---|---|
| 2,261,724 | 11/1941 | Holm | 233/29 X |
| 3,117,928 | 1/1964 | Thylefors | 233/20 R |
| 3,445,062 | 5/1969 | Loddenkemper | 233/29 |

FOREIGN PATENTS OR APPLICATIONS

| | | | |
|---|---|---|---|
| 1,543,693 | 9/1968 | France | 233/20 A |

*Primary Examiner*—George H. Krizmanich
*Attorney, Agent, or Firm*—Burgess, Dinklage & Sprung

[57] ABSTRACT

A centrifugal separator suitable for separating a mixture of a specifically lighter liquid, a specifically heavier liquid, and solids. The separator comprises a disk stack 9 adjacent the drum axis, and a second disk stack 12 in the centrifuging zone 10 between disk stack 9 and the periphery of the drum. The specifically heavier liquid fraction leaves the drum via passageways 20 and discharge openings 21. The separator is well suited to separation of water-oil mixtures containing sludge and metal particles.

4 Claims, 2 Drawing Figures

SEPARATING DRUM FOR THE CENTRIFUGAL TREATMENT OF MIXTURES

BACKGROUND

The invention relates to a separating drum for the centrifuging of liquid mixtures including a specifically heavier liquid and a specifically lighter liquid, and containing solids, in which after a substantial separation of the specifically lighter liquid phase, the specifically heavier liquid containing some of the solids is subjected to a recentrifuging in a second separating chamber.

The centrifuging of liquid mixtures is performed mainly in known separating drums in which the separating chamber comprises a plurality of conical disks having narrow interstices between them, which is known as a disk stack, the zone of separation between the specifically lighter and specifically heavier liquid being established further inwardly or outwardly in the disk stack according to the proportions of the two phases and the desired degree of separation. If the proportion of the lighter phase is smaller, the zone of separation is shifted inwardly, and if it is greater, the zone of separation is shifted outwardly. Normally, the proportion of the specifically heavier phase is greater than that of the specifically lighter phase when an inwardly located zone of separation is established, and is smaller when an outwardly located zone of separation is established. The location of the zone of separation is established when the drum is designed, and depends on the disposition of the ascending passages in the disk stack, and also depends on the application of the centrifuge.

While the separated liquids are removed from the drum in any desired manner, e.g., by means of paring disks, the solids that are present are spun out in the centrifuging chamber, provision often being made for a preliminary separation of the solids in the distributor chamber or in a preliminary separating chamber.

German Auslegeschrift No. 1,075,047, for example, shows an embodiment of this kind.

Depending on the proportion of the solids, a drum having an imperforate peripheral wall or a self-cleaning centrifuge drum can be used, and while a good separation of all three phases is desired, that is accomplished only in the rarest cases.

Let us consider as an example the separation of oil and water mixtures, such as is commonly performed to a great extent on ships. These liquid mixtures contain the light phase, i.e. oil, in major proportion and heavy phase, e.g. water, in minor proportion. These liquid mixtures must furthermore be centrifuged at elevated temperatures in order to achieve good separations.

In this known separating process, more value has hitherto been placed on a precisely separated and water-free oil phase than on an oil-free water phase. Today, however, not only the oil losses resulting from this practice but also the protection of the environment are important, so that the water phase, too, is to be as free as possible from oil.

This requirement, however, is difficult to meet with the centrifuges commonly used, because in order to achieve the essentially required water-free oil, the zone of separation between the two liquids must be situated very closely to the outer margin of the disk stack so as to provide, on the one hand, a large separating surface area in the disk stack for the oil phase, i.e., for the lighter liquid phase, and on the other hand to prevent the solid substance from having to traverse a longer path within the disk stack and thus foul or clog the interstices in the disk stack. A clogged disk stack shortens the run time of the centrifuge, or else more frequent desludging operations have to be performed to clean out the drum, and this in turn leads to losses of oil. This procedure, namely the shifting of the zone of separation to the outer margin of the disk stack, results, of course, in a more poorly separated heavier phase. In addition, the solids, which often settle only in the distribution chamber or in an antechamber, have particles of oil attached to them, which are not separated until they reach the outer centrifuging chamber, and then are entrained by the outflowing heavier phase. Poor separations occur especially when the mixture is emulsion-like, when the necessary temperatures are not maintained, or when the centrifuge is momentarily overloaded. In many cases, therefore an additional centrifuge is used for secondary clarification.

British Pat. No. 565,713, shows the use of centrifuge drums having a plurality of superimposed separating chambers, a preliminary clarification or separation of the liquids being performed in the one chamber, and a secondary centrifuging being performed in the next chamber.

The above designs in each case reduce the separating surface of the centrifuge drum for one phase, e.g., the lighter phase, so that the throughput of the centrifuge with respect to the total volume of the drum is greatly reduced, and thus the separating process is made substantially more costly.

THE INVENTION

The present invention is therefore addressed to the problem of constructing a known separating drum for the centrifuging of liquid mixtures containing solids such that, in addition to the specifically lighter phase well separated in one separating chamber, a well separated specifically heavier liquid phase is also achieved, the heavier phase to be subjected to a secondary centrifuging in an additional separating chamber, without the loss of separating surface area for the specifically lighter phase with respect to the total volume of the centrifuge drum.

Using reference characters of the accompanying drawing for illustration, which drawing is described in detail hereinafter, the invention is characterized by the fact that the separator comprises a second separating chamber or zone 12 comprising a plurality of conical disks, which is disposed outside of the first separating chamber or zone 9, and communicates with the centrifuging chamber or zone 10 over a weir 11 and with the discharge opening or openings 21 over a separating disk 8 which extends into the centrifuging chamber or zone 10.

By means of the second separating chamber disposed in accordance with the invention, the specifically heavier liquid phase is subjected in the region of high centrifugal forces to a further centrifuging treatment, in which any specifically lighter liquid particles and solid particles that may still be present are separated from the specifically heavier phase.

German Pat. No. 1,291,291 also shows a centrifuge drum having a separating disk extending into the centrifuging chamber, the outer margin of said disk being shielded by a conical insert from the centrifuging chamber. This system, however, is for the purpose of permitting filling of the centrifuging chamber with solid matter before a rapid plugging of the discharge passages above the separating disk takes place. The problem with which we are here concerned, however, cannot be solved by that construction due to the lack of a second separating chamber.

Thus, the invention provides a centrifugal separator suitable for separating a three component mixture of specifically lighter liquid fraction, specifically heavier liquid fraction, and a solids fraction, into said three components. The centrifuge comprises a separating drum having an inlet for the mixture disposed adjacent the drum axis, and a disk stack of radially extending disks also adjacent the drum axis and defining a first separating zone for separation of the specifically lighter fraction. Means define a passageway for removal of the separated specifically lighter fraction from the drum. The disk stack is spaced from the periphery of the drum so as to define between the disk stack and the periphery of the drum, a centrifuging zone for separation of the specifically heavier liquid fraction and the solids fraction. According to the invention, a second separating zone is disposed radially outwardly of the first separating zone, in the centrifuging zone. The second separating zone is defined by a second disk stack of radially extending disks. Openings in the disks of the disk stack define a distribution channel in the second disk stack for entrance of specifically heavier liquid fraction and solids fraction from the centrifuging chamber for distribution of the material in the second disk stack. The inwardly disposed end and the outwardly disposed end of the second disk stack are open for, respectively, discharge of a specifically lighter liquid fraction adjacent the first disk stack, and discharge of specifically heavier liquid fraction and solids fraction into the centrifuging zone. A passageway is provided for removal of specifically heavier liquid fraction from the centrifuging zone, having an inlet for specifically heavier fraction adjacent the outwardly disposed end of the second disk stack.

In a preferred embodiment, the second disk stack is disposed adjacent the drum cover, and the lowermost disk has openings intermediate the ends thereof which serve as inlets of the distribution channels. The passageway for removal of specifically heavier fraction can be provided by an imperforate disk overlying the second disk stack and the inner surface of the drum cover, the imperforate disk being spaced from the drum cover so that the passageway is provided therebetween. The disks of the second disk stack and the imperforate disk can be assembled together as a unit.

EXAMPLE

An example of the embodiment of the invention is represented in the appended drawings of which:

Figure 1:
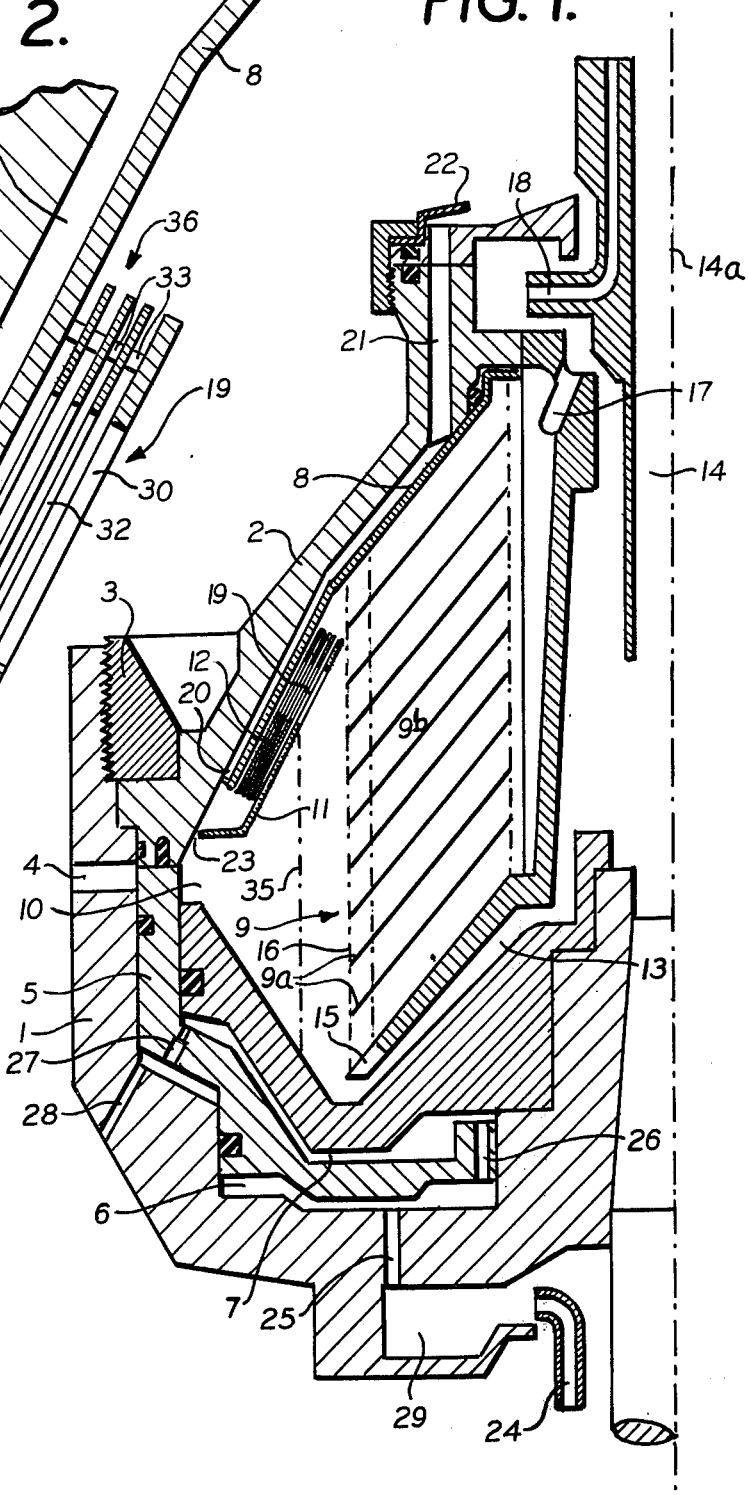
FIG. 1 shows the left half of a self-cleaning centrifugal drum.

Referring to FIG. 1, the centrifugal drum represented in the drawing has a lower body portion 1 and a cover 2 which are held together by means of a ring 3, and it has a distribution chamber 13 to which the mixture to be separated is fed through a feed pipe 14 which is disposed adjacent the drum axis 14*a*.

The mixture to be separated is fed from the distribution chamber 13 around the distributor foot 15 and passes into the ascending passages 16 disposed at or adjacent the outer margin of the disk stack 9 which is composed of the conical radially extending disks 9*a* and forms the first separating chamber or zone 9*b* disposed adjacent the drum axis. The distributor foot 15, and the disk stack 9, and the apertures in those parts for the ascending of the feed, can be of conventional design, e.g. that shown in Steinacker U.S. Pat. No. 2,665,061, FIG. 1. The specifically lighter liquid phase passes through the interstices in the disk stack 9 in the first separating chamber or zone 9*b* concentric with the drum axis, and through passages 17, and is removed by means of a paring disk 18, which constitute a passageway for removal of the specifically lighter liquid fraction. The specifically heavier liquid and the solid substance slide into the centrifuging chamber or zone 10. The centrifuging chamber or zone 10 is defined by the periphery of the drum and the disk stack 9 which is spaced from said periphery. The specifically heavier liquid phase passes over a weir 11 through the ascending channels 19 for recentrifuging in the second separating chamber or zone 12 constructed in accordance with the invention and equipped with conical radially extending disks 31 (FIG. 2) to provide a second disk stack 36. The second separating zone 12 is disposed radially outwardly of the first separating zone 9*b*, in the centrifuging zone. Following the second centrifuging, the specifically heavier liquid, as can also be seen in FIG. 2, passes around the outer edge of the separating disk 8 into the passages 20, and is carried via discharge openings 21 (FIG. 1) and, for example, a weir or ring dam 22, out of the drum. The light phase secondarily separated in the second separating chamber or zone 12 passes through the disk stack 9, and the solids removed in the second separating chamber or zone 12 pass through the gap 23 between the weir 11 and the drum cover 2 into the centrifuging chamber or zone 10.

Figure 2:
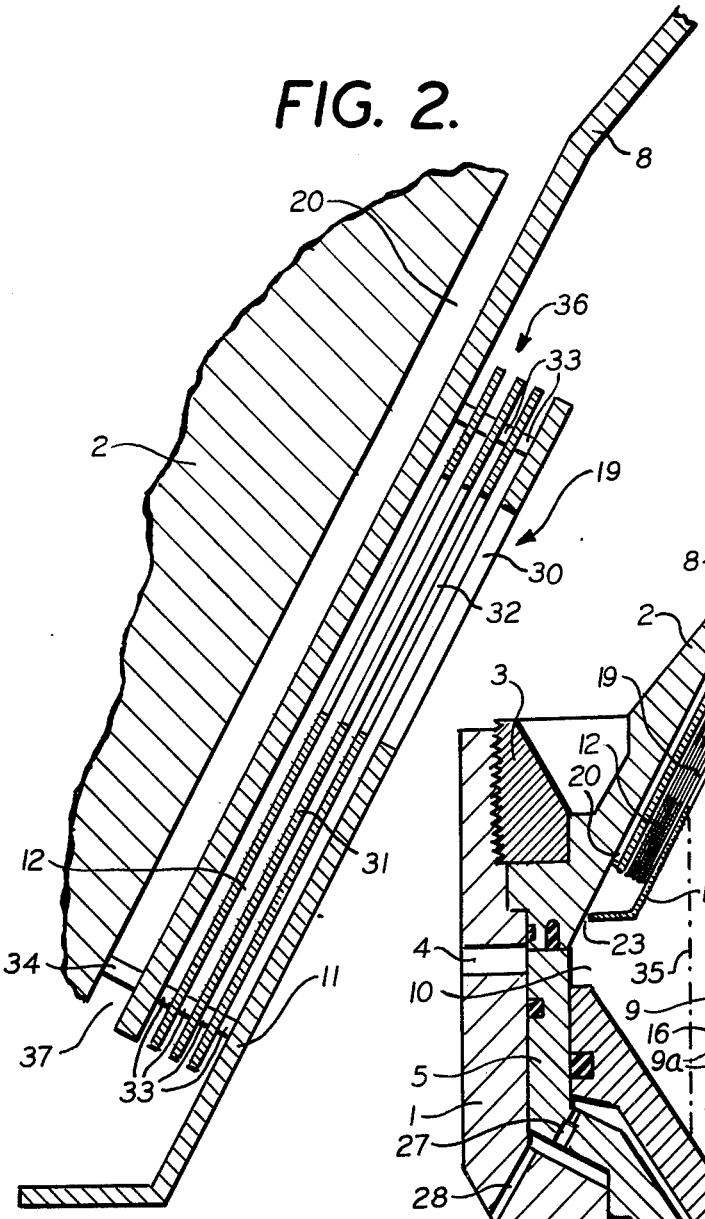
FIG. 2 is an enlarged showing of the second separating chamber 12, of the drum illustrated in FIG. 1.

Referring to FIG. 2, which is a showing of the second separating chamber or zone 12, on the enlarged scale, the specifically heavier liquid flows through openings 30 in weir 11 and thence through the ascending distribution channels 19 defined by the openings 30 and the openings 32 in disks 31 which form the disk stack 36 of the second separating chamber or zone 12. Weir 11 is an outer disk of the second disk stack 36, which is disposed adjacent the drum cover, and the openings 30 therein serve as inlets of the distribution channels 19. The ascending channels 19 provide distribution channels in the second disk stack 36 for entrance of the material and distribution thereof in the second disk stack. The inwardly disposed end and the outwardly disposed end of the second disk stack 36 are open for, respectively, discharge of specifically lighter liquid fraction adjacent the first disk stack 9, and discharge of specifically heavier liquid fraction and solids fraction into the centrifuging zone 10. The separating disk 8, which is an imperforate disk overlying the second disk stack 36, is spaced from the drum cover 2 so as to provide passageways 20 for removal of specifically heavier liquid fraction from the centrifuging zone, the passageways having inlet 37 for the specifically heavier liquid fraction adjacent the outwardly disposed end of the second disk stack 36. Specifically heavier liquid from centrifuging chamber or zone 10 flows into the second separating chamber or zone 12 from the level in the centrifuging chamber 10 indicated by the broken line 35 in FIG. 1.

The weir 11, disks 31, and separating disk 8 are assembled together as a unit by connectors 33 which are disposed at circumferentially spaced points. Spacers 34 are provided between the drum cover 2 and the separating disk 8 at circumferentially spaced points.

The openings 4 on the periphery of the centrifuging drum are for the discharge of the solids and can, in this embodiment, be opened and closed during operation by the axially displaceable piston 5 by the use of control liquid for the closing and opening chambers 6 and 7 for the operation of the piston 5. Thus, to lower the piston 5, control fluid can be introduced into chamber 29 via pipe 24, so that it passes through duct 25 and fills the closing chamber 6, and overflows through duct 26 to opening chamber 7. The opening chamber 7 fills up and thereon the piston 5 moves down so that discharge openings 4 communicate with centrifuging chamber 10. To close the discharge openings 4, flow of control fluid through pipe 24 is shut off, whereupon the fluid in opening chamber 7 discharges through passageways 27 and 28, and the level of control fluid in closing chamber 6 moves outwardly to the location of duct 25. The control fluid in the closing chamber outwardly of duct 25 then forces the piston 5 to the closed position.

It will be understood that there are ascending passages 16 in the first disk stack 9, openings 30, 32 in the second disk stack 36, and passages 17 and 21 at circumferentially spaced intervals about the drum.

In the, e.g. water-oil mixtures, the solids are such as sludge and metal particles.

What is claimed is:

1. A centrifugal separator suitable for separating a three component mixture of a specifically lighter liquid fraction, a specifically heavier liquid fraction, and a solids fraction, into said three components comprising:

a. a separating drum having an inlet for the mixture disposed adjacent the drum axis, and a disk stack of radially extending disks adjacent the drum axis defining a first separating zone for separation of the specifically lighter fraction, and means defining a passageway for removal of the separated specifically lighter fraction from the drum, the disk stack being spaced from the periphery of the drum so as to define between the disk stack and the periphery of the drum a centrifuging zone for separation of the specifically heavier liquid fraction and the solids fraction, b. a second separating zone disposed radially outwardly of the first separating zone, in the centrifuging zone, defined by a second disk stack of radially extending disks, means defining distribution channels in the second disk stack for entrance of specifically heavier liquid fraction and solids fraction from the centrifuging chamber into and distribution in the second disk stack, the inwardly disposed end and outwardly disposed end of the second disk stack being open for, respectively, discharge of specifically lighter liquid fraction adjacent the first disk stack, and discharge of specifically heavier liquid fraction and solids fraction into the centrifuging zone, and c. means defining a passageway for removal of specifically heavier liquid fraction from the centrifuging zone, having an inlet for specifically heavier liquid fraction adjacent the outwardly disposed end of the second disk stack.

2. Centrifugal separator of claim 1, the second disk stack further comprising an outer disk having openings therein which serve as inlets of the distribution channels.

3. Centrifugal separator of claim 2, the drum comprising a lower body member and a cover, the second disk stack being disposed adjacent the drum cover with said outer disk being lowermost in the disk stack, said means defining a passageway for the removal of specifically heavier liquid fraction comprising an imperforate disk overlying the second disk stack, the imperforate disk being spaced from the drum cover so that said passageway is provided therebetween.

4. Centrifugal separator of claim 3, the disks of the second disk stack and the imperforate disk being secured together as a unit.

* * * * *